US005787532A

United States Patent [19]

Langer et al.

[11] Patent Number: 5,787,532

[45] Date of Patent: Aug. 4, 1998

[54] INTERNAL MATTRESS WALL STRUCTURES INTERLOCKINGLY ENGAGEABLE WITH MATTRESS INNERSPRING ASSEMBLIES

[75] Inventors: Paul J. Langer, Bay Village; Robert F. Wagner, Medina, both of Ohio

[73] Assignee: The Ohio Mattress Company Licensing and Components Group, Cleveland, Ohio

[21] Appl. No.: 726,028

[22] Filed: Oct. 4, 1996

[51] Int. Cl.[6] ..... A47C 27/00

[52] U.S. Cl. ..... 5/717; 5/739

[58] Field of Search ..... 5/716, 717, 718, 5/739, 253, 761

[56] References Cited

U.S. PATENT DOCUMENTS

| | | | |
|---|---|---|---|
| 1,865,043 | 6/1932 | Pittoni | 5/717 |
| 2,826,769 | 3/1958 | Drews | 5/717 |
| 2,940,089 | 6/1960 | Koenigsberg . | |
| 3,173,159 | 3/1965 | Hart | 5/717 |
| 3,262,135 | 7/1966 | Fasanella . | |
| 3,618,146 | 11/1971 | Ferdinand . | |
| 3,822,426 | 7/1974 | Mistarz | 5/717 |
| 3,848,283 | 11/1974 | Ikeda . | |
| 4,067,076 | 1/1978 | Krier . | |
| 4,677,701 | 7/1987 | Galumbeck . | |
| 4,907,309 | 3/1990 | Breckle . | |
| 5,048,167 | 9/1991 | Heffley et al. . | |
| 5,113,539 | 5/1992 | Strell . | |
| 5,133,116 | 7/1992 | Wagner et al. . | |
| 5,210,890 | 5/1993 | Hagglund . | |
| 5,239,715 | 8/1993 | Wagner . | |
| 5,467,488 | 11/1995 | Wagner . | |
| 5,537,699 | 7/1996 | Bonaddio et al. . | |

FOREIGN PATENT DOCUMENTS

| | | | |
|---|---|---|---|
| 780450 | 4/1935 | France | 5/717 |

*Primary Examiner*—Flemming Saether
*Attorney, Agent, or Firm*—Calfee, Halter & Griswold LLP

[57] ABSTRACT

Internal mattress wall structures interlockingly engageable with mattress innerspring assemblies provide a structurally integrated resilient mattress support edge to which the mattress padding and upholstery is integrally attached. The wall structures include a main body section with a vertically oriented wall surface and a plurality of parallel flanges which mechanically engage the innerspring assembly by compression fit between the intermediate and terminal convolutions of the perimetrical coils of the innerspring assembly. Corner structures contiguous with side and end wall structures form a contiguous smooth side wall with support characteristics comparable to an innerspring assembly.

22 Claims, 17 Drawing Sheets

INTERNAL MATTRESS WALL STRUCTURES INTERLOCKINGLY ENGAGEABLE WITH MATTRESS INNERSPRING ASSEMBLIES

FIELD OF THE INVENTION

The present invention pertains generally to sleeping mattresses and the internal construction of sleeping mattresses and, more particularly, to sleeping mattresses having innerspring assemblies in the form of interconnected arrays of coil springs.

BACKGROUND OF THE INVENTION

Sleeping mattresses and other reflexive support structures are commonly constructed with a plurality of interconnected internal coils or springs, as described, for example, in U.S. Pat. No. 4,726,572. Rows of coils are held in parallel alignment by helical wires laced about tangential points of adjacent coils, such as the upper and lower terminal convolutions of the coils which may have a greater radial extent than the intermediate turns. A borderwire is also attached to the coils about the entire perimeter of the coil array (i.e., the "perimetrical coils"), by a clip attached to each coil or a helical lacing wire wound co-axially with the borderwire along the length and width of the top and bottom edges of the innerspring assembly, to define the overall shape of the mattress, and to provide rigidity to the top and bottom edges of the mattress. The connected coils and borderwire provide an innerspring assembly about which layers of padding, bunting, ticking and upholstery materials are attached to complete the mattress. The borderwire provides an important top and bottom edge or frame which the seams of the upholstery material must closely follow in order to give the mattress a proper finished appearance critical to consumer appeal. The borderwire is typically constructed of a much heavier gauge wire than the coils, must be bent at a rather small radius to define the corners of the mattress, and is difficult to attach to the coil array. The padding and upholstery layers are also attached directly to the innerspring assembly by hog rings, which is a difficult and inaccurate assembly procedure which often produces uneven, wavy taped edges which detracts from the appearance of the finished product.

The edge or perimeter areas of mattresses of this type of construction are typically subjected to increased loads and load cycles resulting from the common tendency of people to sit on the edge when entering or leaving the bed from a prone position, to use the edge as a seat, or to stand on the edge. A person sitting over a relatively small array of coils of the innerspring assembly applies a more concentrated load upon the coils than does a more even distribution of force over a larger number of coils, as occurs when lying on the mattress in a prone position. Excessive spring loading at the mattress edges produces accelerated wear which results in sag or set, rounding off the top surface of the mattress. This rounding off is accentuated by the pre-existing curvature of the mattress edges as a result of the many layers of padding which converge at the edges.

Many different approaches have been taken to provide extra structural support at the perimetric areas of a mattress support surface while maintaining desired resiliency. Many of these approaches involve simply adding material such as padding or foam to the exterior and/or interior of an innerspring assembly about the perimeter. For example, U.S. Pat. No. 2,940,089 describes the use of a block or strip which is attached to the lateral faces of a mattress innerspring assembly to provide a flush surface for overlying upholstery.

Multiple fasteners are required to secure the block to the innerspring. U.S. Pat. No. 3,262,135 discloses a rigid (wood) border member which encompasses an array of mattress springs but which is not directly or integrally attached to the coils or the borderwire of the assembly. U.S. Pat. No. 3,618,146 describes a mattress border stabilizer in the form of foam strips which are inserted between the convolutions of the lateral coils of the mattress innerspring assembly, and between the upper and lower border wires. In another embodiment, a single piece of foam is horizontally slit at one or more elevations to slide over the intermediate convolutions of the lateral coils. Similarly, U.S. Pat. No. 5,133,116 describes insertion of a resilient rope between the intermediate convolutions of peripheral coils. U.S. Pat. Nos. 3,848,283 and 4,067,076 each describe the use of foam pieces held adjacent the lateral sides of mattress coil arrays but not integrally attached to the coils. And U.S. Pat. No. 5,239,715 describes a rhomboid shaped mattress border stabilizer positioned adjacent the interior lateral sides of the outer rows of coils.

These disclosures do not describe any resilient support elements for mattress edges which also serve as structural elements of the mattress, which are mechanically engaged with the innerspring assembly, and which form complete and integral structural walls, edges and corners of the interior of the mattress, which can eliminate the need for conventional steel borderwires, and to which the padding and upholstery layers of the mattress may be directly attached. Also, many of the different types of foam pieces proposed for use with innerspring assemblies are in practice very difficult to position and attach to the innerspring assembly and the layered mattress materials. Additionally, the conventional visco-elastic foams (e.g. polyurethane) used in the prior art do not provide the structure support properties of the extruded foam wall structures of the present invention.

SUMMARY OF THE INVENTION

The present invention overcomes these and other disadvantages of the prior art by providing a structural resilient edge for a mattress innerspring assembly which interlockingly engages with the perimetric coils of a mattress innerspring assembly and which forms the top and bottom edge corners of the innerspring assembly. In accordance with one aspect of the invention, an internal mattress edge structure includes a main body section having a planar lateral external wall, top and bottom surfaces generally perpendicular to the wall and extending inwardly from the external face of the wall, the intersections of the top and bottom surfaces with the external face of the wall defining top and bottom edges, and parallel rows of flanges attached to and extending laterally inward from an interior side of the main body section, each of the flanges having an extension section and a terminal section attached to the extension section, the terminal section configured for mechanical engagement between convolutions of perimetrical coils of a mattress innerspring assembly, wherein the wall and the top and bottom surfaces of the main body section form the internal walls and edges of the mattress.

In accordance with another aspect of the invention, a structurally integrated mattress includes and innerspring assembly having a plurality of parallel rows of vertically oriented helical coils laced together with cross-helical lacing wires, internal mattress wall structures having a main body section with a vertical wall surface, and parallel flanges extending laterally from the main body section opposite the vertical wall surface, each of the parallel flanges having a terminal sections mechanically engaged with convolutions of perimetrical coils of the innerspring assembly whereby the vertical wall surface is positioned parallel with the vertical axes of the coils, and layers of mattress padding and upholstery material attached to the wall structures.

These and other novel aspects of the present invention are hereinafter described in particularized detail with specific reference to the accompanying Figures wherein like reference numerals refer to like elements.

DETAILED DESCRIPTION OF PREFERRED AND ALTERNATE EMBODIMENTS

Figure 1:
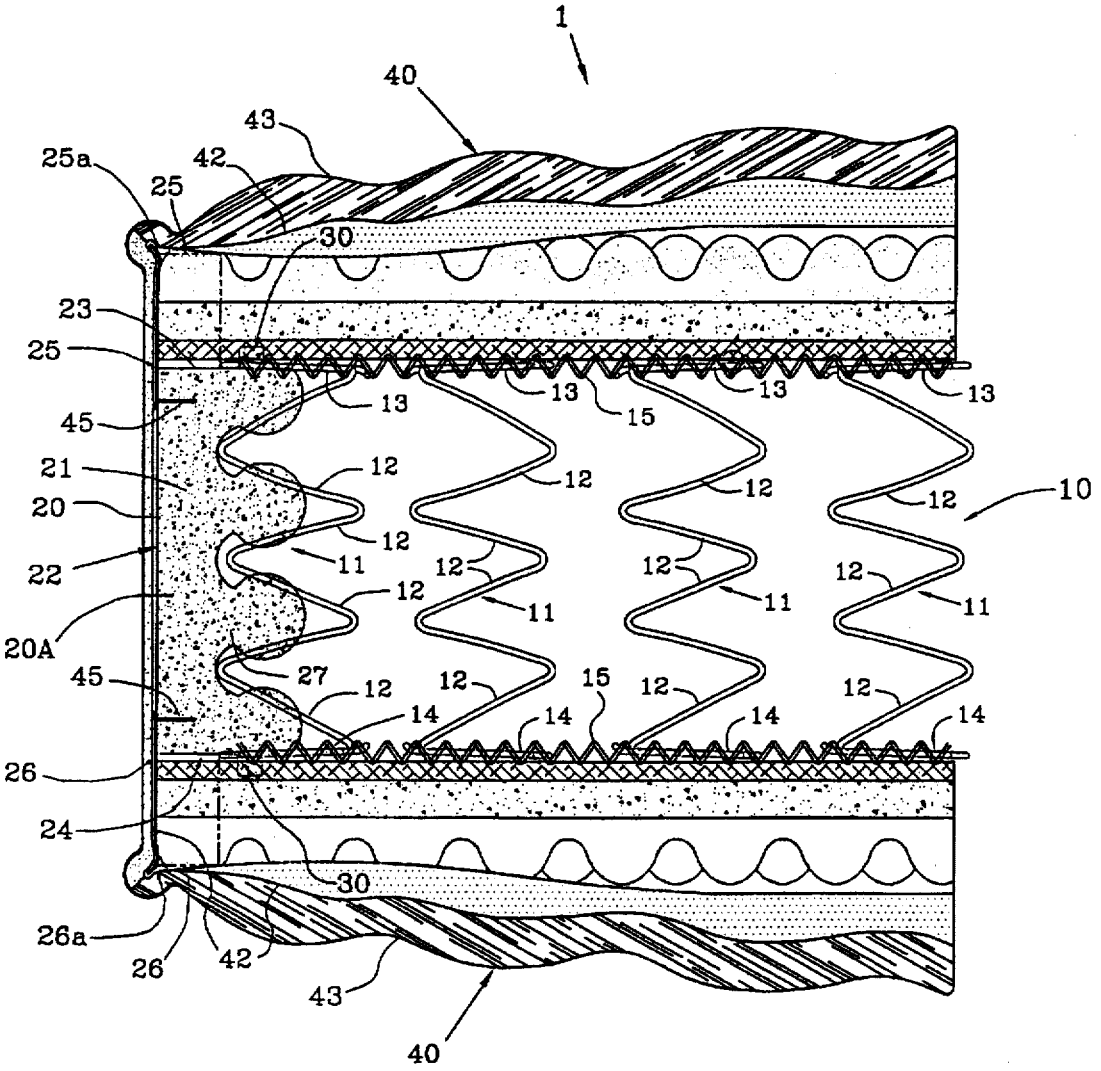
FIG. 1 is a cross-sectional view of a side wall area of a mattress constructed with an internal mattress wall structure of the invention.

With reference to FIG. 1, there is illustrated a cross-section of a mattress, indicated generally at 1, taken across the width of the mattress so that the view is along the length of the mattress. The following description is made with general reference to generally rectilinear mattresses having orthogonal side and end walls, regardless of the lengths of the walls as may vary among different conventional mattress from twin to king. The present invention pertains to mattress of all sizes. The internal construction of the mattress includes an innerspring assembly, indicated generally at 10, including a plurality of spring coils 11 (referred to herein simply as "coils"), each having a series of intermediate helical convolutions 12 and top and bottom terminal convolutions, 13 and 14 respectively, each of the convolutions having a common generally vertically oriented axis. The coils 11 may be arranged in the innerspring assembly in any manner, but are most commonly arranged in rows to fill substantially the entire area within the generally rectilinear perimeter of a mattress, as described for example in U.S. Pat. No. 4,092,749, incorporated herein by reference, and shown in FIG. 8. The terminal convolutions 13 and 14 of each of the coils are commonly connected by cross-helical lacing wires 15 which are laced about the tangential terminal convolutions of the coil in adjacent rows, across the width of the innerspring assembly 10. An end cross-helical wire is also installed along the terminal convolutions of the coils in the end rows of the innerspring assembly. However, because there may be no borderwire in the innerspring assembly with which the wall structures of the invention are engaged, there is no side helical wire about the terminal convolutions along the side of the innerspring assembly. Although described in this regard, it is understood that the invention can also be practiced in connection with an innerspring assembly which is entirely conventional, having upper and lower border wires, and a helical lacing wire about the border wires and the perimetrical coils.

An internal mattress wall structure 20 is interlockingly engaged with each of the convolutions of all of the coils along the side walls, end walls and corners of the innerspring assembly to form a substantially continuous wall structure which surrounds or encompasses the innerspring assembly. The internal mattress wall structure 20 includes the structure which engages the longitudinal side walls of the innerspring assembly is referred to herein as the "internal mattress side wall structure 20A" or simply the "side wall structure". And the structure which engages the end walls of the innerspring assembly is referred to herein as the "internal mattress end wall structure 20B" or simply the "end wall structure".

Figure 2:
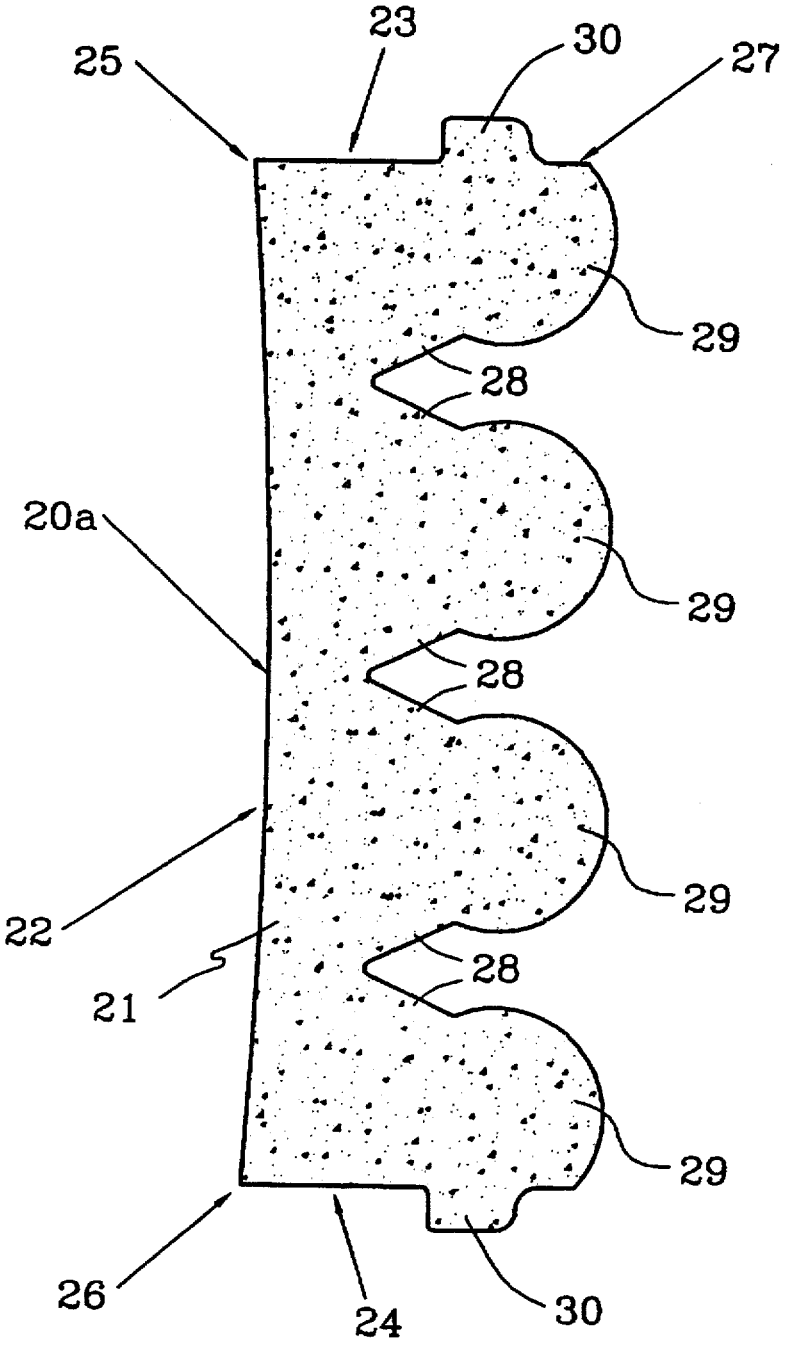
FIG. 2 is a cross-sectional view of an internal mattress side wall structure of the invention.

As further shown in FIG. 2, the internal mattress wall structure 20 includes a main body section 21, a generally planar side wall 22, a top surface 23 and bottom surface 24 which are each generally perpendicular to side wall 22 to form a top edge 25 and a bottom edge 26, parallel rows of flanges 27 attached to and extending laterally inward from a side of the main body section opposite side wall 22, each of the flanges 27 having an extension section 28 and a terminal section 29. In some embodiments the extension section 28 is essentially eliminated. The flanges 27 are specially configured for mechanical engagement with the perimetrical coils of the innerspring assembly by frictional fit between the terminal and intermediate convolutions of the perimetrical coils, as specifically shown in the fully engaged position in FIG. 1. In this embodiment, the extension section 28 of each of the flanges is tapered to generally follow the helical angle between the convolutions of each of the coils, and the terminal section 29 has a generally rounded cross-section so that it is slightly compressed by adjacent convolutions, and to facilitate insertion of the flanges between the coil convolutions. The top and bottom surfaces 23 and 24 of the internal mattress side wall structure are overlapped by the terminal convolutions of the coils and thereby compressed toward the adjacent intermediate convolution to grip the entire cross-section of the wall structure 20 between each of the convolutions of the coils along the side of the innerspring assembly, from the top to the bottom of the innerspring assembly and coils. A substantial space is provided between each of the flanges 27, extension sections 28 and terminal sections 29 in order to achieve the close mechanical fit of the flanges between the coil convolutions.

Figure 3:
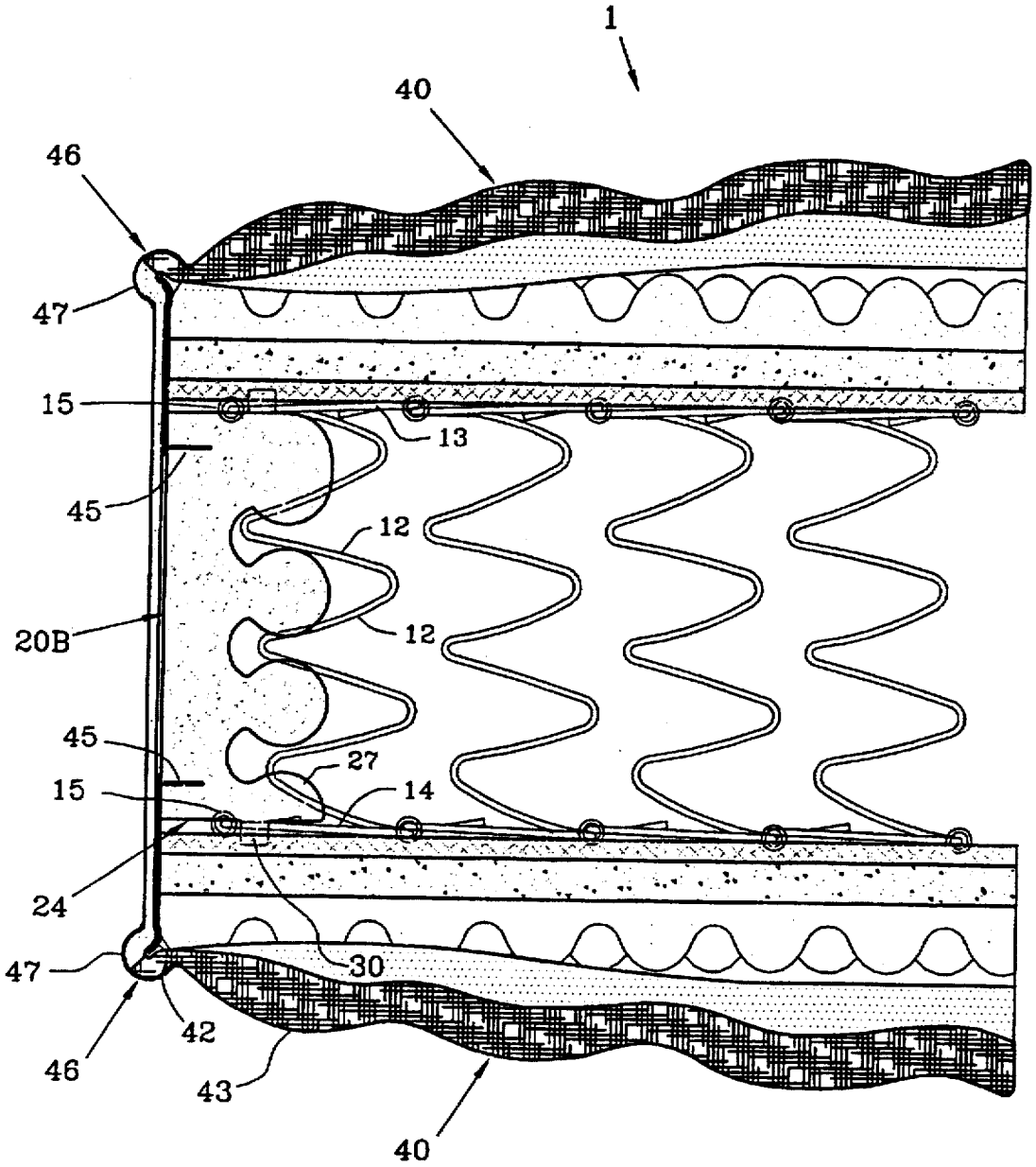
FIG. 3 is a cross-sectional view of an end wall area of a mattress incorporating the internal mattress end wall structure of the invention.

As further shown in FIGS. 1 and 2, the top and bottom surfaces 23 and 24 each further include a ridge 30 which protrudes generally perpendicularly from the surface and approximately aligned with the terminal sections 29. As shown in FIG. 1, the ridges 30 are positioned relative to terminal sections 29 to be overlapped by the terminal convolutions of the coils, thereby further contributing to the interlocking mechanical engagement of the internal mattress wall structure with the innerspring assembly. Ridge 30 of side wall structure 20A shown in FIG. 1 mechanically engages with the first few helical turns of lacing wires 15. Ridge 30 of end wall structure 20B shown in FIG. 3 is mechanically engaged against an internal side of lacing wires 15.

As shown in FIGS. 1 and 2, when the wall structure is formed from extruded foam, the side wall 22 may include a slight concave or internal camber which is forced outward to a vertical plane by convergence of the flanges 27 as they are interlocked with the coil convolutions.

Figure 1A:
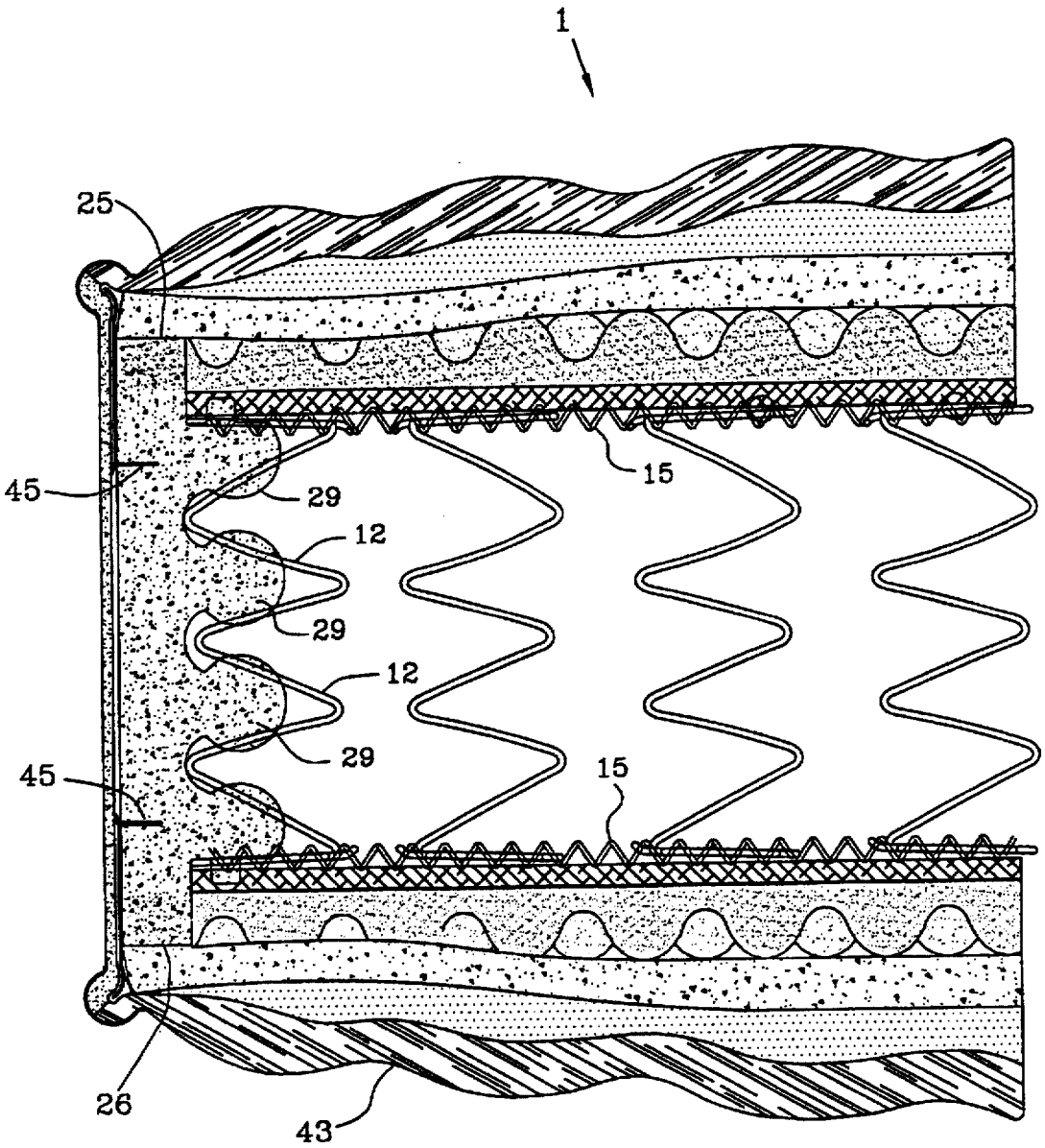
FIG. 1A is a cross-sectional view of an end wall area of a mattress constructed with an internal mattress wall structure of the invention.
Figure 1B:
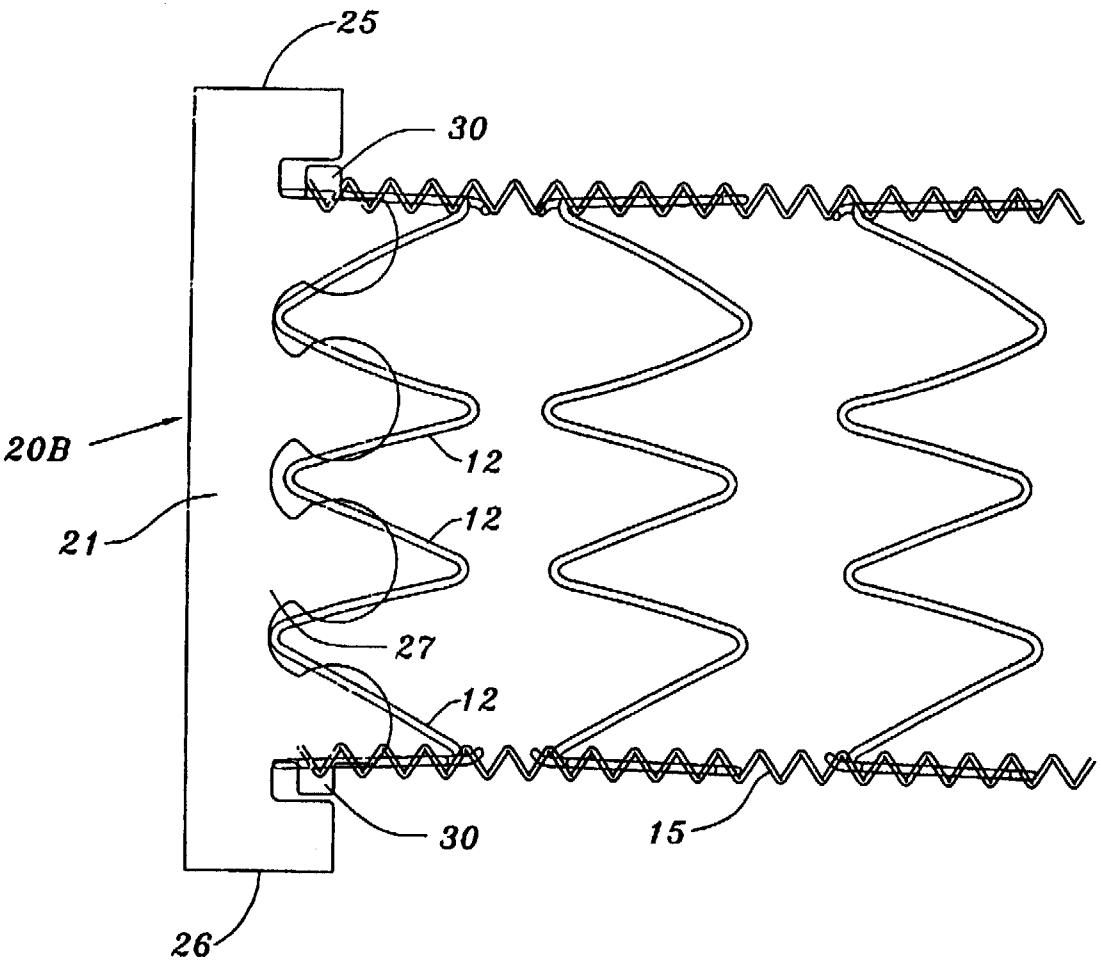
FIG. 1B is a cross-sectional view of an alternate embodiment of an internal mattress wall structure of the invention engaged with an innerspring assembly.

As shown in phantom in FIG. 1, and in FIGS. 1A and 1B, the side wall 22 may be extended vertically beyond the top and bottom surfaces 23 and 24, to thereby extend beyond the terminal convolutions of the coils, to position extended top and bottom surfaces 25 and 26, and edges 25*a* and 26*a*, closer to the exterior (upholstered) edge of the mattress. The side wall 22 in this embodiment thus extends substantially over the entire surface area of the side walls of the finished mattress, to thereby create an even smoother flat finished appearance to the walls of the finished mattress, which greatly contributes to the consumer appeal of the mattress. In the alternate embodiment of FIG. 1B, top and bottom edges 25*a* and 26*a* are widened to provide greater horizontal surface area to the wall structures, which further improves support characteristics and facilitates padding and upholstery material attachment.

Figure 1C:
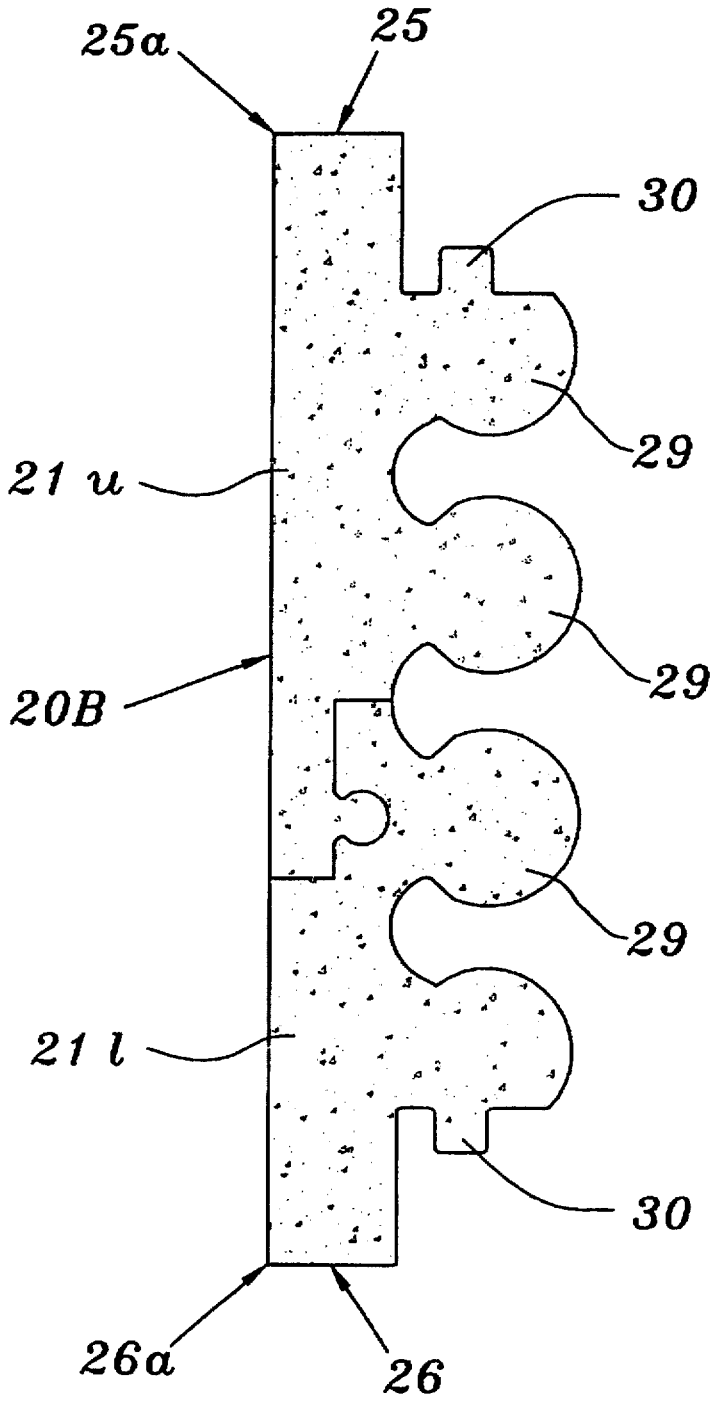
FIG. 1C is cross-sectional view of an alternate embodiment of an internal mattress wall structure of the present invention.

For thicker mattress, for example having an innerspring assembly with taller coil springs, and more padding on the sleeping surfaces, the height or vertical extent of the wall structures 20 can be increased by stacking rows of extruded wall structures, as shown for example in FIG. 1C. An upper wall structure 20*u* may be simply stacked or interlockingly engaged with a lower wall structure 20*l* to increase the height of side wall 22 as measured from top surface 23 to bottom surface 24. The lower individual height profiles of structures 20*u* and 20*l* are also advantageous because they are somewhat simpler to manufacture by a foam extrusion process than structures having a larger cross-sectional profile.

Figure 1D:
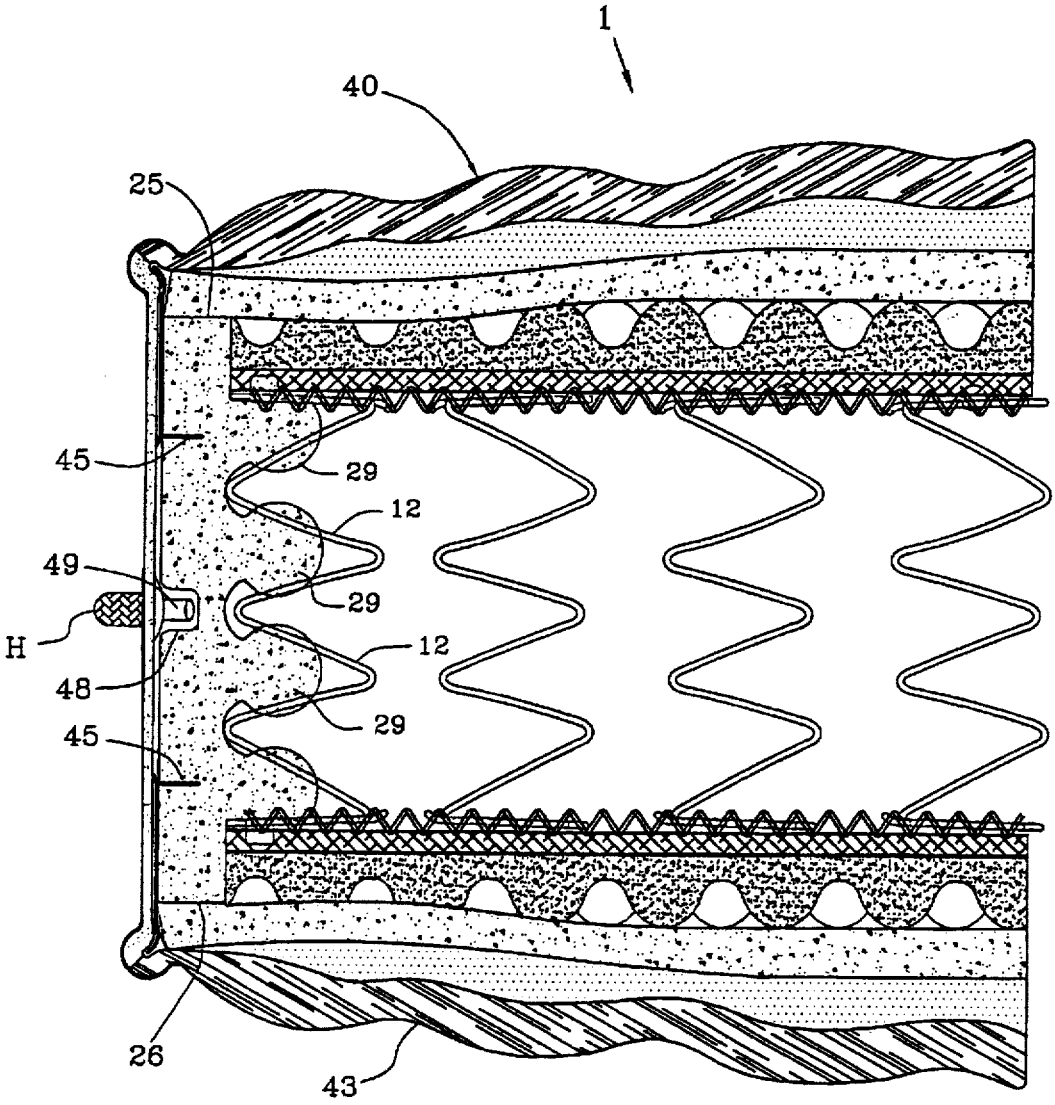
FIG. 1D is a cross-sectional view of an edge area of a mattress constructed with an alternate embodiment of an internal mattress wall structure of the invention.

As shown in FIG. 1D, clearance for handle mounting fittings 49 is provided by notches 48 in the main body section 21 of the wall structure 20, to project through side wall 22 and the upholstery material thereover, at several points around the perimeter of the mattress for attachment of handles to the mattress material and/or upholstery. Notches 48 effectively conceal the presence of fittings 49 to provide for a smooth finished appearance to the upholstery about the handle H.

In each of the embodiments of the wall structures of the invention, it is important to note that as a result of the foam material construction and the cross-sectional geometry of the interlockingly flanges, the wall structures have spring and support characteristics which are comparable and even superior to the support characteristics of the innerspring assembly, so that the sides and edges of a mattress constructed with the wall structures of the invention provide at least equal support as the innerspring area of the mattress, and improved support at the edges of mattresses of the prior art, including those relying principally upon a borderwire for edge support. Also, each of the described structures can be made from extruded closed cell foam such as polyethylene which has excellent resilient properties for the described use. The extrusion process forms a tough outer skin to each of the structures which assists in the mechanical engagement of the structures with an innerspring assembly, i.e., the structures cannot be easily torn by the wire of the innerspring. The skin also allows the structures to hold the described shapes and configurations throughout the life of the mattress.

Figure 4:
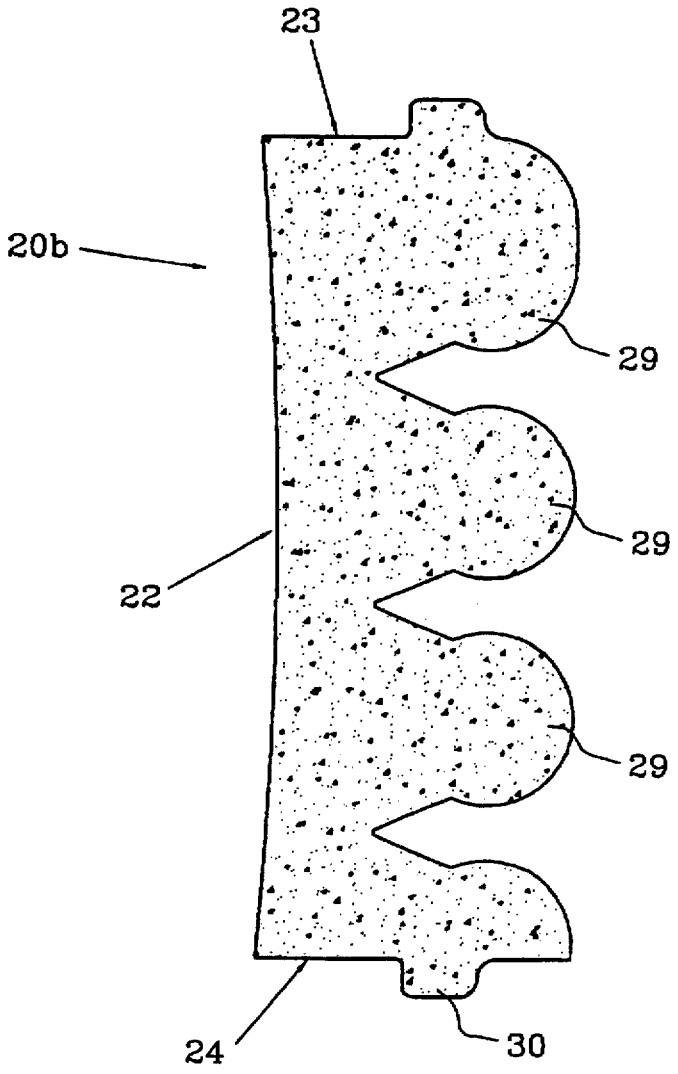
FIG. 4 is a cross-sectional view of an internal mattress end wall structure of the present invention.

As shown in FIGS. 3 and 4, the cross-sectional profile of the internal mattress end wall structure 20B, configured for engagement with the ends of the innerspring assembly, is slightly different from side wall structure 20A, in that the lowermost flange 27 is partially truncated to allow it to fit between the terminal convolution and the adjacent intermediate convolution which are at a different elevation than the convolutions facing the side of the assembly, and to allow overlapping of the ridge 30 on bottom surface 24 by the end helical wire which laces the terminal convolutions of the coils along the end of the innerspring assembly, to further enhance the mechanical engagement of the end wall structure 20B with the innerspring assembly.

Figure 10A:
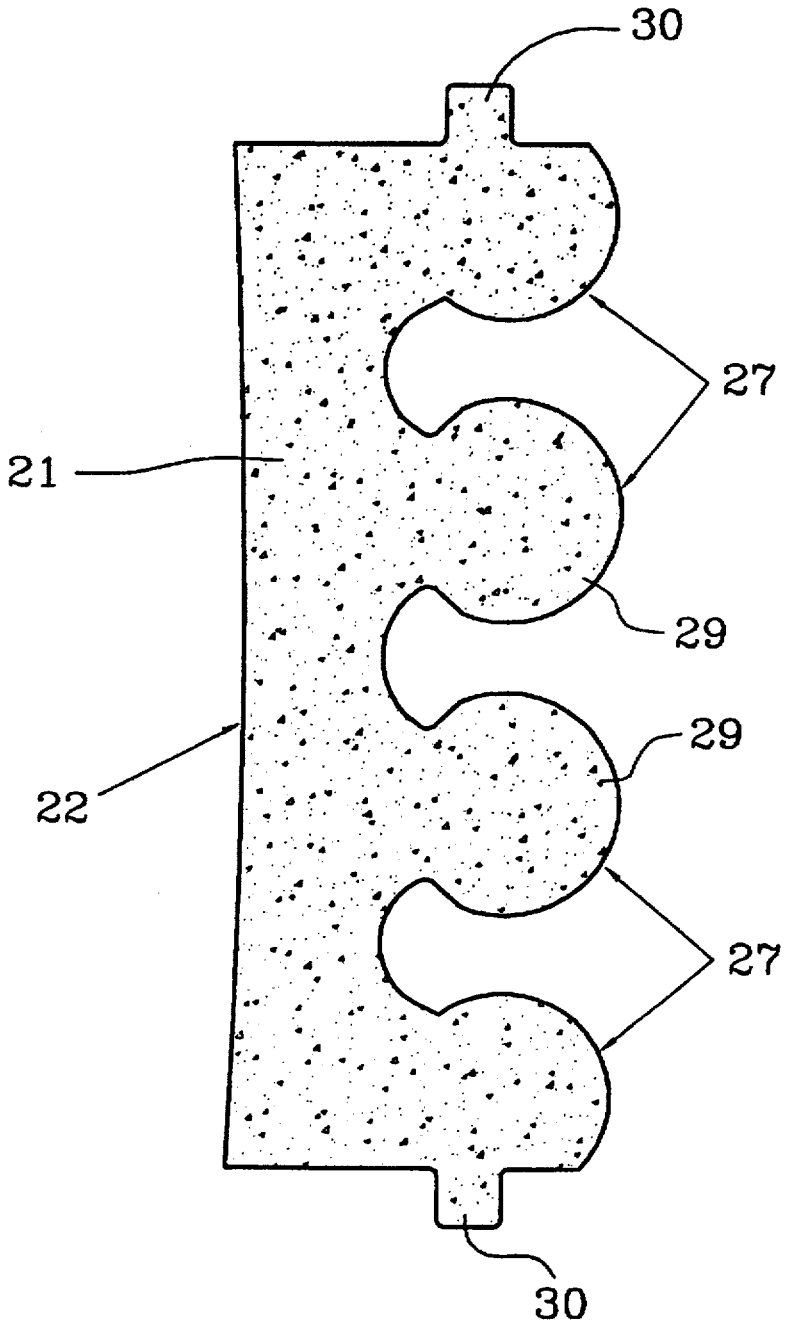
FIGS. 10A and 10B are cross-sectional views of alternate preferred embodiments of the internal mattress wall structures of the invention.
Figure 10B:
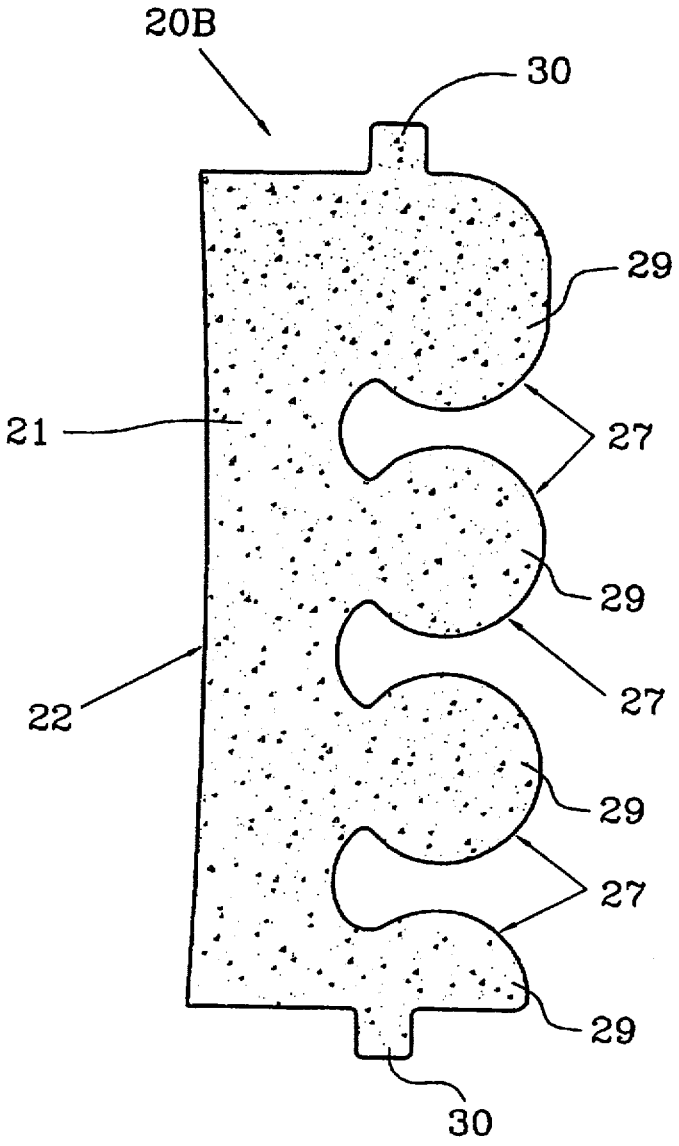

Other cross-sectional profiles of the wall structures are within the scope of the invention, such as illustrated for example by FIGS. 10A and 10B, wherein the terminal sections 29 are slightly more circular, the flanges 27 minimized, and the gaps between the flanges slightly enlarged to provide increased adaptability of the structure for engagement with helical coils of various dimensions. Significantly, there are gaps between each of the flanges 27 and terminal sections 29, to facilitate engagement of the wall structures with the coils, and to allow sufficient room for passage of the helical convolutions of the coils. Also, ridges 30 are slightly elongated to increase the frictional gripping force with the overlying terminal convolutions and helical lacing wires. In fact, the wall and corner structures of the invention can be adapted to fit with any type of helical coil array so long as the flanges are dimensioned to fit between the coil convolutions. For example, the main body section 21, wall surface 22 and/or top and bottom flanges 27 which engage between the terminal and intermediate coil convolutions can be over or undersized so that the overall height of the wall structure is equal to or greater than that of the perimetrical coils.

In practice, the side and end wall structures are readily interlockingly engaged with an innerspring assembly by simply aligning the top and bottom edges 25 and 26 with the terminal convolutions of the perimetrical coils, whereat the flanges 27 are aligned with the gaps between the coil convolutions, and a striking force applied along the linear extent of the vertical wall 22 to urge the terminal sections 29 into engagement with the coil convolutions. In other words, the wall structures simply snap into engagement about the perimeter of the innerspring assembly, without the need for any special tools, fasteners, or assembly techniques.

Figure 5:
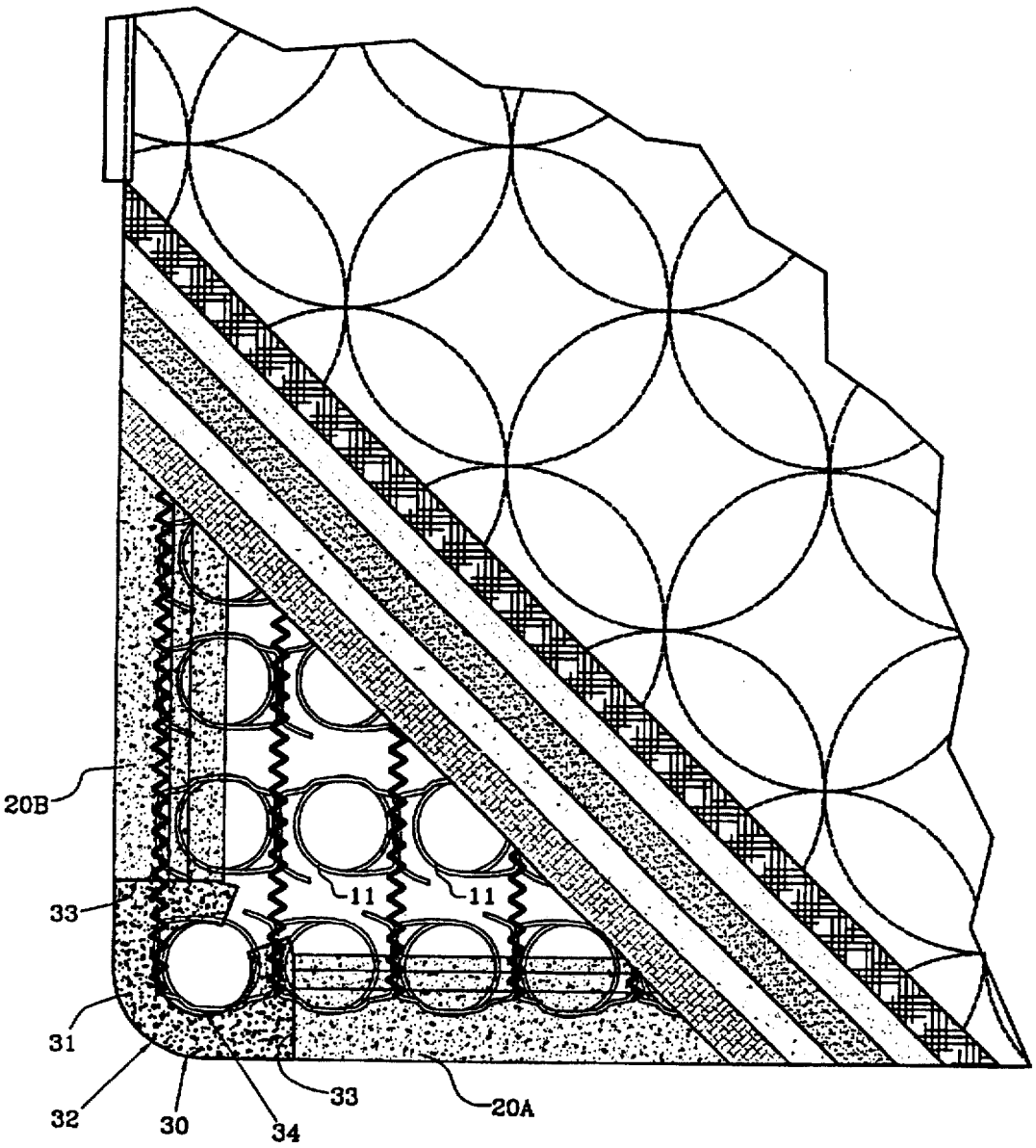
FIG. 5 is a partially cutaway top view of a corner of a mattress incorporating an internal mattress edge structure of the invention.
Figure 6:
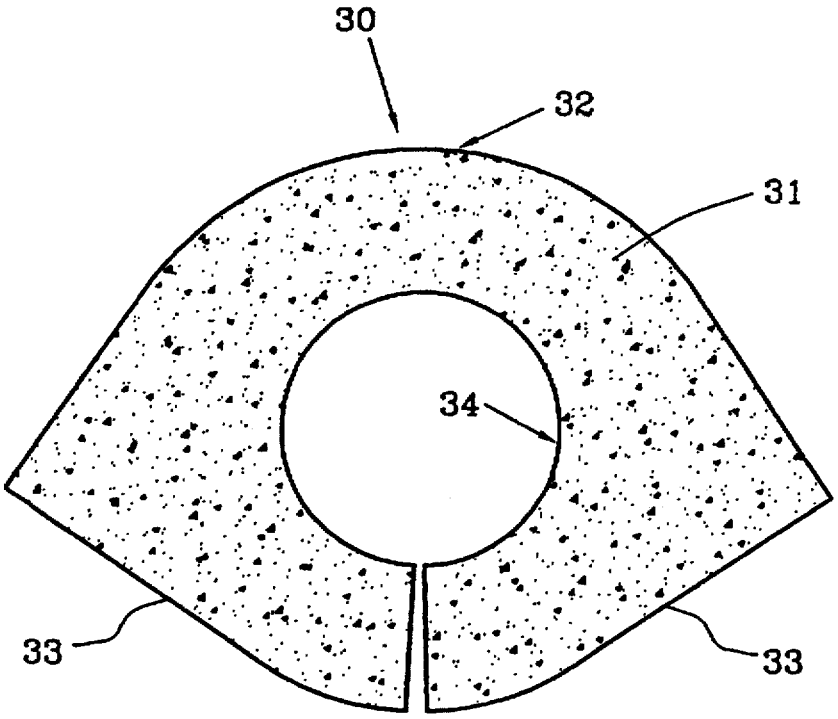
FIG. 6 is a cross-sectional view of an internal mattress corner wall structure of the invention.

Referring now to FIGS. 5 and 6, the internal mattress wall structure 20 further includes corner pieces 30, configured to snap fit and lock about the corner coils of a rectangular innerspring assembly, and to abut the terminal ends of the side and end wall structures 20A and 20B to form a smooth corner wall to the internal mattress structure. The corner pieces of this embodiment have a main body section 31 with an external arcuate corner wall 32, intersecting interior walls 33, and a generally circular cavity 34 in the main body dimensioned to fit radially about the convolutions of the single coil at the corner of the innerspring assembly. As shown in FIG. 6, the corner pieces may be formed as a single piece extrusion, as further described below, with the arcuate angle of the corner less than ninety degrees, so that the interior walls 33 must be spread apart to install the piece about the coil, to thereby position the interior walls perpendicular and flush to the exterior wall of the abutting side and end wall structures, and to provide a mechanical gripping force of the corner piece upon the corner coil.

Figure 6A:
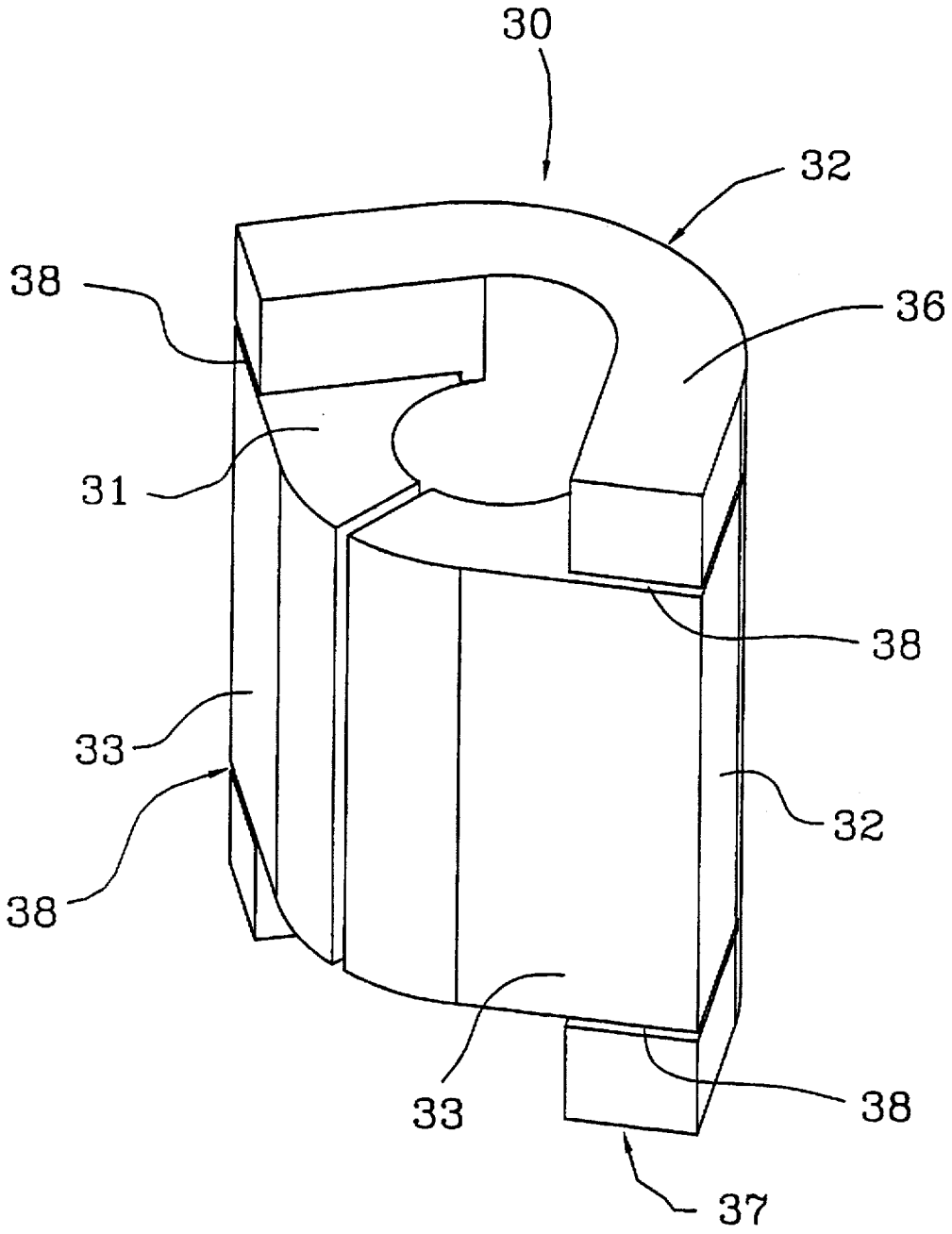
FIG. 6A is a perspective view of an alternate embodiment of an internal mattress corner wall structure of the invention.

As shown in FIG. 6A, corner pieces 30 may be alternately formed with vertically extended external arcuate corner walls 35 to form extended top and bottom arcuate surfaces 36 and 37 which are coplanar with extended top and bottom surfaces 25 and 26 of the corresponding embodiment of side wall structures 20. A notch 38 may be formed between the interior walls 33 and corner walls 35 to facilitate engagement with the corner coils and with the upper and lower terminal convolutions of the coils.

Figure 7:
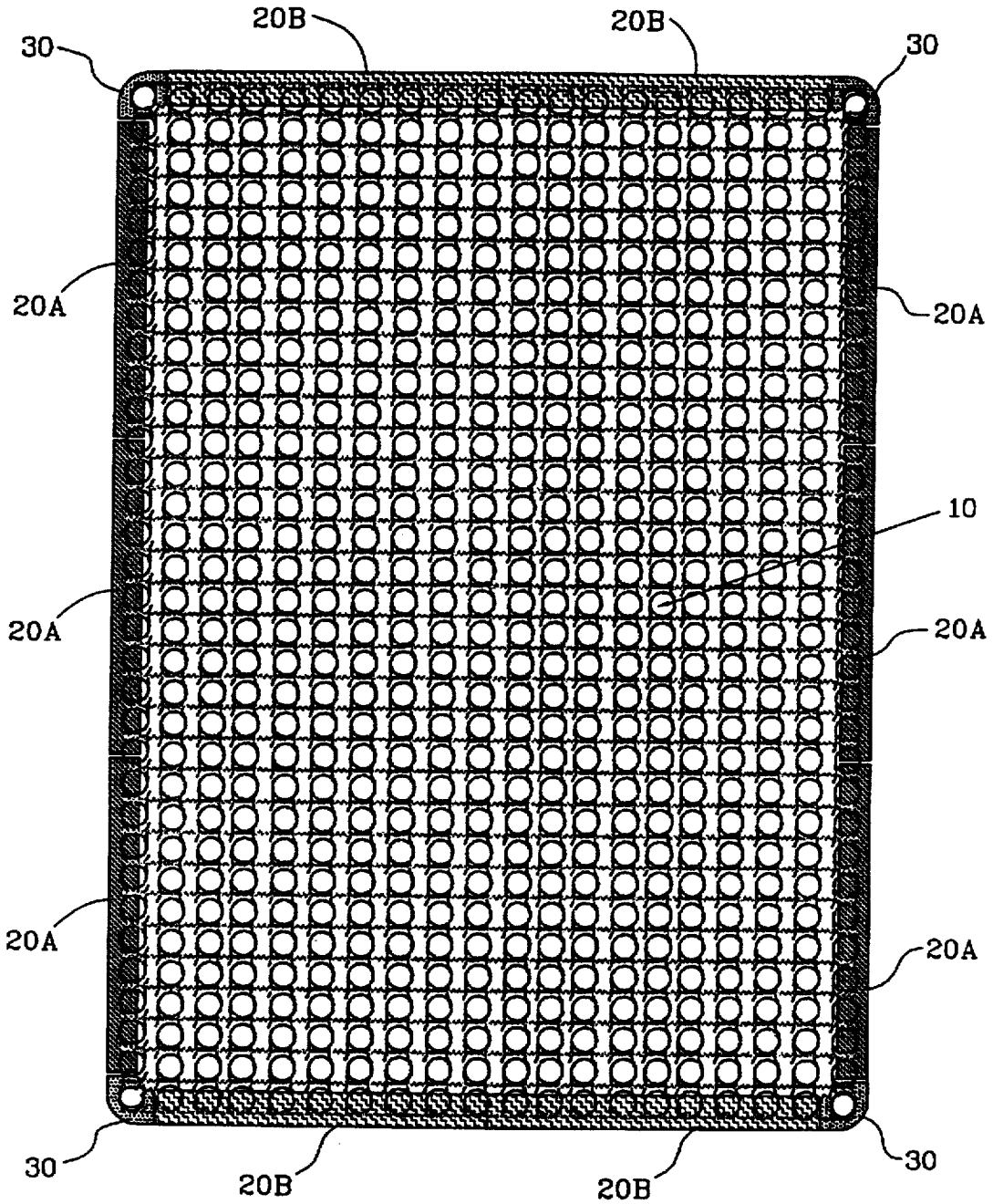
FIG. 7 is a top view of a mattress innerspring assembly engaged with internal mattress wall structures of the invention.

As shown in FIG. 7, the linear length of the side wall structures 20A and the end wall structures 20B can be selectively cut to closely match the length of the innerspring assembly sides and ends so that the combined structures engage all or substantially all of the perimetrical coils, with the abutting ends of the wall structures and the corner pieces forming a flush and continuous vertical wall surface 22 about the entire perimeter of the mattress.

As shown in FIGS. 1, 3 and 5, the wall and corner structures are critical to the integral and accurate attachment of the many layers of mattress padding and upholstery materials about the innerspring assembly and directly to the wall and corner structures. As in a typical mattress, multiple fabric and material layers 40 are laid over the terminal convolutions of the coils and extend to the mattress edges 25 and 26, as clearly defined by the wall structures 20A and 20B. Prior to attachment of an exterior upholstery layer 43, an interior covering or liner 42 is pulled down over the edges 25 and 26, flush against vertical wall surface 22, and stapled directly through the wall surface 22 into main body section 21 by a plurality of fasteners 45, which may be for example flare staples or barbed tacks or helical pins or the like, which when inserted through wall surface 22, and through the skin layer of the structure formed in an extrusion manufacturing process, firmly engage the wall structures to tightly secure the lining and all of the layers of padding thereunder to the internal structure of the mattress. The broad area of the wall surface 22 allows the mattress assembler to optimally select the points of attachment of the liner 42 to locate the mattress exterior edge 46 substantially equidistant from the top and bottom edges 25 and 26 of the wall structures 20. The wall surface 22 thereby makes possible an upholstered tape edge 47 which is very straight and true, since it follows top and bottom edges 25 and 26, or 25*a* and 26*a*. The straight tape edge 47 also contributes greatly to the consumer appeal of the finished mattress.

As shown for example in FIGS. 1, 3 and 5, any padding and upholstery material layers used in mattress construction can be attached in various combinations to the mattress structures of the invention, including but not limited to wool laminate, polyurethane and/or high performance foam, cotton felt or batting, MT backing, pin convoluted foam SP3 fiber pad, or other suitable materials.

Figure 8:
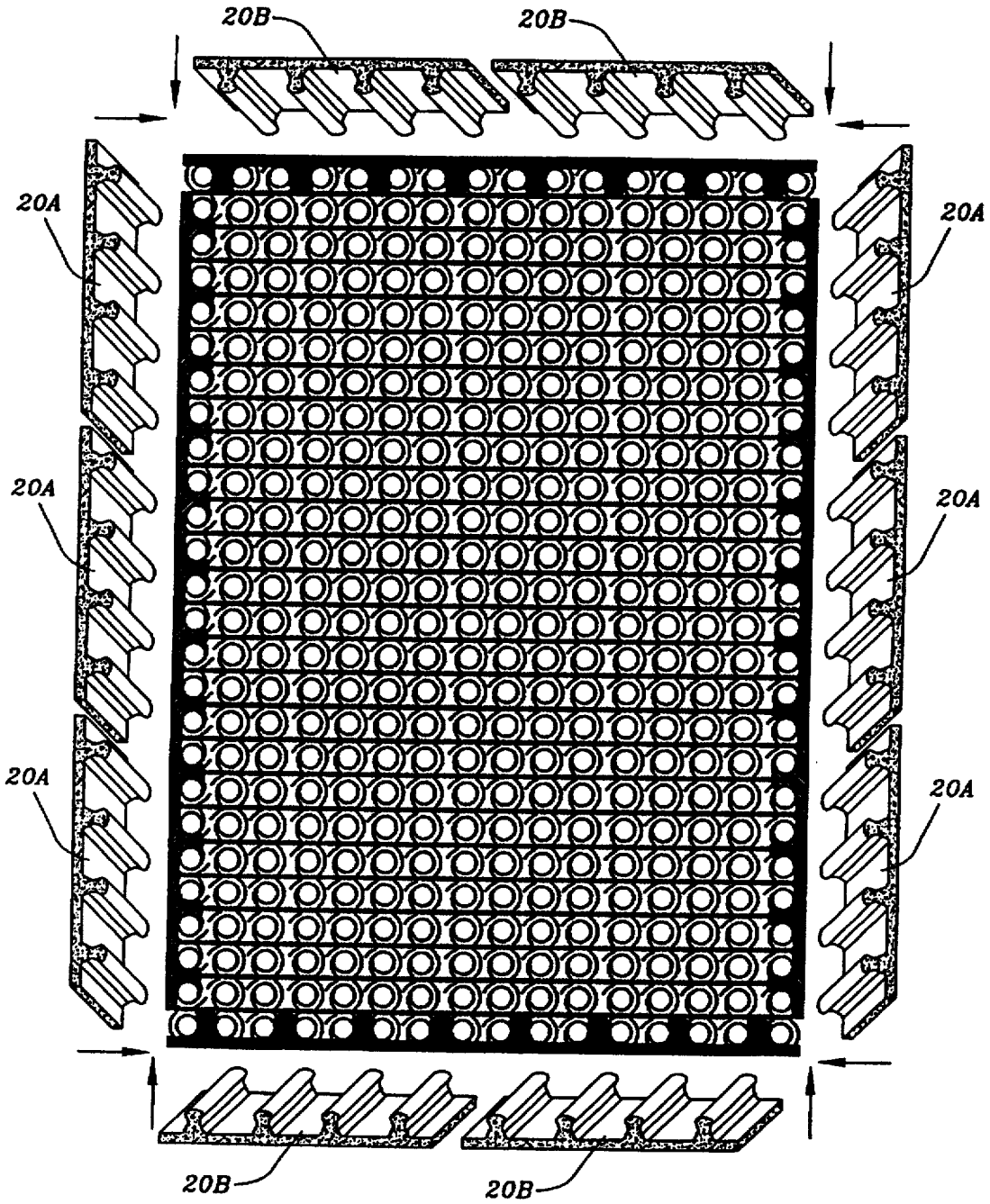
FIG. 8 is a combined perspective and plan view of an alternate embodiment of the internal mattress wall structures of the invention.
Figure 9:
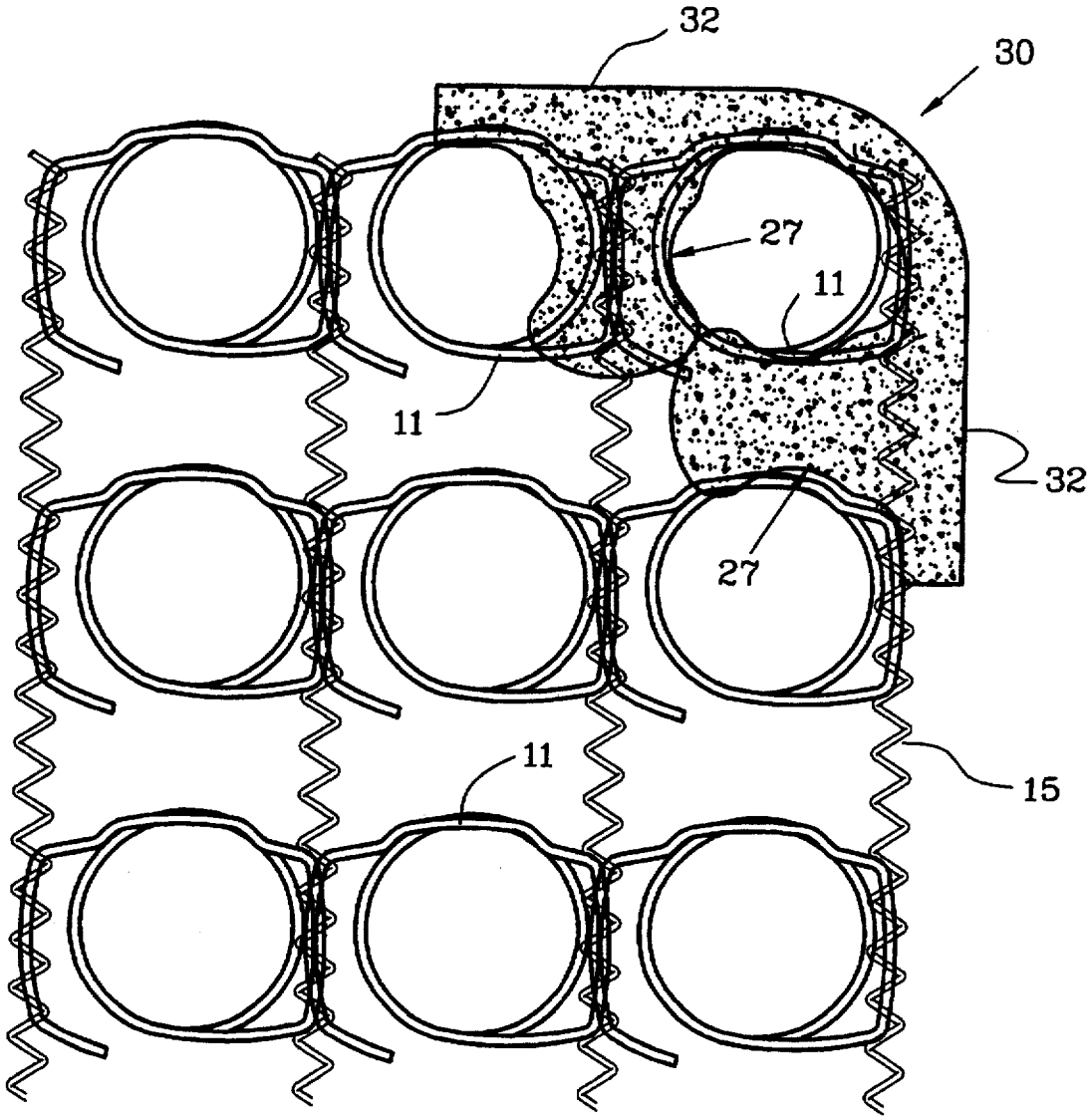
FIG. 9 is a plan view of a corner area of an innerspring assembly engaged with an alternate embodiment of an internal mattress corner wall structure of the invention.

FIG. 8 illustrates an alternate embodiment of the wall structures of the invention in which the flanges 27 are veritcally oriented and relatively spaced to fit between and mechanically engage the perimetrical coils. The extension and terminal sections of the flanges can be similarly configured as described above, and the main body section similarly provides the external wall surface 22 and the top and bottom edges 25 and 26. As shown in FIG. 9, the corner piece 30 of this embodiment is simply a short section of the wall structure with two flanges spaced to surround and engage the corner coil and its two adjacent coils, to form the smooth arcuate corner wall 32.

Figure 11:
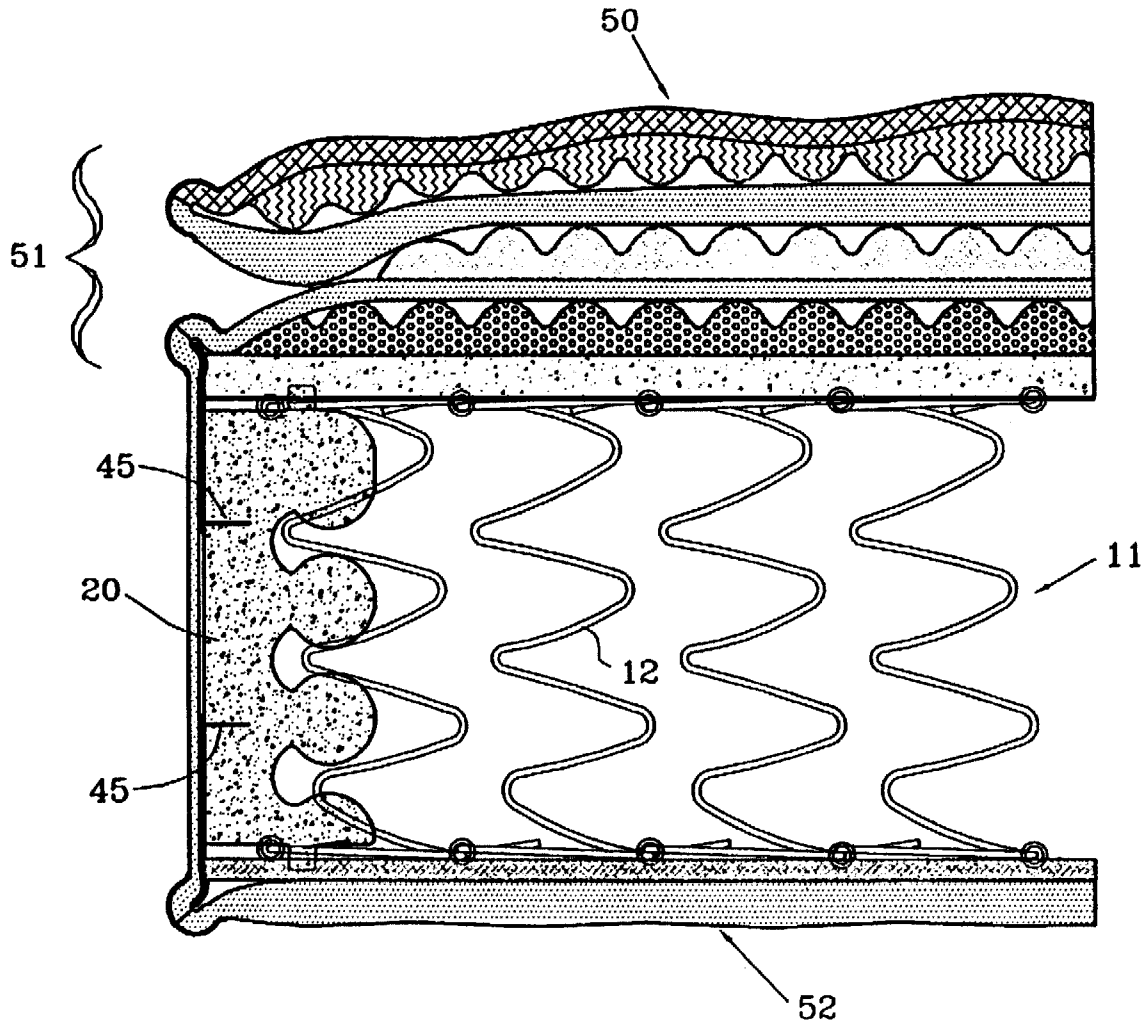
FIG. 11 is a cross-section of an edge area of a single-sided mattress of the present invention.

As illustrated by FIG. 11, because the wall structures of the invention contribute significantly to the long-term support characteristics of a mattress so constructed, the structures 20 can be advantageously incorporated into a one-sided mattress, indicated generally at 50, having additional padding and upholstery materials attached to an upper surface 51, and a generally flat bottom surface 52. In this embodiment, a substantial amount of additional padding and material is secured to the internal mattress structure in the same manner as described above with flare staples 45. Constructed with foam padding material and innersprings which do not take a set, only the upper surface 51 is used as the sleeping surface. The additional perimetric support provided by the wall structures 20 allows the one-sided mattress 50 to perform equivalently to a conventional mattress which is regularly flipped. Also, the elimination of padding and upholstery material from the bottom surface reduces the overall height of the mattress, and provides for a more stable fit upon a mattress foundation.

Any of the wall and corner structures of the invention can be formed by extrusion of thermoplastic extrudable foam materials such as polyethylene, polyethylene-based polymers, including EVA, ionomers and other co-polymers and are preferably made of extruded closed cell foam. Thickness, shape and contours of the structures can be selectively varied through extrusion die design and material selection. The thickness of the skin which forms about the structures in the extrusion process can be varied by extrusion rate. Materials and additives can be selected to provide any desired edge support characteristics and attributes such as firmness, density, compression, load deflection, fire retardancy or color. Also, the invention allows for the complete elimination of the relatively stiff borderwires of innerspring assemblies of the prior art, thus enabling a mattress constructed in accordance with the invention to be folded along a transverse axis, for example in half, to facilitate handling and shipment.

The invention thus provides improved internal mattress wall structures which are easily assembled with conventional innerspring assemblies by interlocking engagement without the need for any specialized assembly tools or fasteners. The smooth wall surface of the structures provides an optimal area for integral attachment of the interior padding layers, as well as the well-defined top and bottom edges, all of which improve the finished appearance of the upholstered edges of the mattress.

Although the invention has been described with reference to certain preferred and alternate embodiments, it will be appreciated by those of ordinary skill in the art that many different variations and modifications could be made to the wall and corner structures described without departing from the basic principles and concepts of the invention, so that any such variations and modifications are equivalent to the invention as defined by the accompanying claims.

What is claimed is:

1. An internal mattress wall structure interlockingly engageable with coils of a mattress innerspring assembly to serve as a resilient internal structural component of a mattress, the wall structure comprising:

a main body section having a generally planar wall surface, top and bottom surfaces intersecting the wall surface, a plurality of parallel flanges extending laterally from the main body section away from the wall surface and adapted to be inserted between convolutions of perimetrical coils of an innerspring assembly, each of the flanges being spaced apart from adjacent flanges and having terminal sections adapted for mechanical engagement with convolutions of perimetrical coils of an innerspring assembly, a ridge rising from the top and bottom surfaces at a point laterally inward from the wall surface, the planar wall surface of the wall structure is adapted to be positioned at a perimeter of an innerspring assembly whereat the ridge on the top and bottom surfaces of the main body is positioned and adapted to be partially overlapped by coils of a mattress innerspring assembly such that the ridge is positioned inwardly of an outer extent of the perimetrical coils, and the wall surface is adapted to extend at least from a top of the innerspring assembly to a bottom of the innerspring assembly to serve as a structural wall of a mattress.

2. The wall structure of claim 1 wherein the flanges are tapered flanges adapted to generally conform to a helical angle of innerspring assembly coils with which the wall structure is engageable.

3. The wall structure of claim 1 wherein a cross-sectional configuration of the terminal sections of the flanges is generally circular.

4. The wall structure of claim 1 wherein the wall surface is internally cambered.

5. The wall structure of claim 1 wherein at least one of the flanges is partially truncated.

6. The wall structure of claim 1 constructed of extruded foam.

7. The wall structure of claim 1 wherein a vertical length of the wall surface is at least equal to a height dimension of coils of an innerspring assembly with which the wall structure is engageable.

8. The wall structure of claim 1 engaged about a perimeter of a mattress innerspring assembly.

9. The wall structure of claim 1 constructed of cast polymer foam.

10. The wall structure of claim 1 having a generally linear extent for engagement with a straight side or end wall of an innerspring assembly.

11. The wall structure of claim 1 in combination with a generally rigid wall structure corner piece having a generally curved external wall which intersects interior walls and a generally cylindrical internal cavity for attachment about a corner coil of an innerspring assembly, the interior walls adapted to face ends of the wall structure.

12. The wall structure of claim 1 comprising upper and lower sections which are arrangable relative to a mattress innerspring assembly to form a continuous side wall to a mattress innerspring assembly.

13. The wall structure of claim 1 mechanically engaged with a mattress innerspring assembly.

14. The wall structure of claim 1 constructed of extruded closed cell foam.

15. The wall structure of claim 1 wherein a vertical length of the wall surface is greater than a height dimension of coils of an innerspring assembly with which the wall structure is engageable.

16. A mattress comprising:

a mattress innerspring assembly having a plurality of interconnected coils arranged in generally parallel rows, and perimetrical coils to define a generally rectilinear innerspring assembly, an internal mattress wall structure comprising a main body section having a planar wall surface, top and bottom surfaces generally perpendicular to the wall surface, a ridge extending from the top and bottom surfaces, and a plurality of parallel flanges extending laterally from the main body section opposite the wall surface, the flanges being spaced apart and having terminal sections mechanically engaged with perimetrical coils of the innerspring assembly, the internal mattress wall structure interlockingly engaged with convolutions of the perimetrical coils of the mattress innerspring assembly by insertion of the wall structure flanges and the ridges between convolutions of the perimetrical coils, terminal convolutions of the perimetrical coils contacting and overlapping the ridges such that the ridge is positioned inwardly of an outer extent of the perimetrical coils, the wall structure thus positioned so that the planar wall surface is positioned about a perimeter of the innerspring assembly to define an internal perimeter of the mattress, and extends at least from a top of the innerspring assembly to a bottom of the innerspring assembly to form internal top and bottom edges of the mattress, and mattress padding and upholstery material overlying the innerspring assembly and the internal mattress wall structure and attached directly to the internal mattress wall structure.

17. The mattress of claim 16 wherein the internal mattress wall structure includes a plurality of linear sections of wall structures with abutting contiguous ends whereby the wall structures substantially encompass a perimeter of the innerspring assembly.

18. The mattress of claim 16 further comprising a generally rigid foam corner structure having a main body section with an arcuate wall surface which intersects interior walls, and an opening in the main body section for receiving a corner coil whereby the corner structure is engaged about a corner coil, and the interior walls face ends of the internal mattress wall structure.

19. The mattress of claim 16 wherein the mattress padding and upholstery material is attached to the internal mattress wall structure by flare staples through the material and into the main body section.

20. The mattress of claim 16 wherein the coils are interconnected by lacing wires, and lacing wires connecting the perimetrical coils are positioned between the ridge and the planar wall surface of the internal mattress wall structure.

21. A one-sided mattress having a single padded sleeping surface and a generally flat bottom surface, the mattress comprising:

a mattress innerspring assembly having a plurality of interconnected coils arranged in generally parallel rows, an upper and lower support surface, and perimetrical coils to define a generally rectilinear innerspring assembly, an internal mattress wall structure comprising a main body section having a planar wall surface, top and bottom surfaces generally perpendicular to the wall surface, a ridge extending from the top and bottom surfaces, and a plurality of parallel flanges extending laterally from the main body section opposite the wall surface, the flanges being spaced apart and having terminal sections mechanically engaged with perimetrical coils of the innerspring assembly, the internal mattress wall structure interlockingly engaged with convolutions of the perimetrical coils of the mattress innerspring assembly by insertion of the wall structure flanges and the ridges between convolutions of the perimetrical coils, terminal convolutions of the perimetrical coils overlapping the ridges such that the ridge is positioned inwardly of an outer extent of the perimetrical coils, the wall structure thus positioned so that the planar wall surface is positioned about a perimeter of the innerspring assembly to define an internal perimeter of the mattress, and extends at least from the top of the innerspring assembly to the bottom of the innerspring assembly to form internal top and bottom edges of the mattress, and mattress padding and upholstery material overlying the top surface of the innerspring assembly and the internal mattress wall structure and attached directly to the internal mattress wall structure to provide a single padded sleeping surface, and mattress upholstery material closely attached to the bottom surface of the wall structure and the innerspring assembly to form a generally flat mattress bottom.

22. An internal mattress wall structure interlockingly engageable with coils of a mattress innerspring assembly to serve as a resilient internal structural component of a mattress, the wall structure comprising:

a main body section having a generally planar wall surface, top and bottom surfaces intersecting the wall surface, a plurality of parallel flanges extending laterally from the main body section away from the wall surface and adapted to be inserted between convolutions of perimetrical coils of an innerspring assembly, each of the flanges being spaced apart from adjacent flanges and having terminal sections adapted for mechanical engagement with convolutions of perimetrical coils of an innerspring assembly, radiused cavities between the spaced apart flanges, the flanges being tapered to generally conform to a helical angle of innerspring assembly coils, wherein a cross-sectional configuration of the terminal sections of the flanges is generally circular, and the planar wall surface of the wall structure adapted to be positioned at a perimeter of an innerspring assembly with the flanges inserted between convolutions of the perimetrical coils, the terminal sections of the flanges positioned generally within the perimetrical coils, and portions of the convolutions of the perimetrical coils between the flanges.

* * * * *